US012741769B2

(12) United States Patent
Werner et al.

(10) Patent No.: US 12,741,769 B2
(45) Date of Patent: Sep. 22, 2026

(54) METHOD AND APPARATUS FOR THE HANDLING OF BAGS FOR (HYGIENE) PRODUCTS

(71) Applicant: Focke & Co. (GmbH & Co. KG), Verden (DE)

(72) Inventors: Stefan Werner, Hamburg (DE); Stefan Riegler, Hamburg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 20 days.

(21) Appl. No.: 18/865,900

(22) PCT Filed: May 9, 2023

(86) PCT No.: PCT/EP2023/062223

§ 371 (c)(1),
(2) Date: Nov. 14, 2024

(87) PCT Pub. No.: WO2023/222444

PCT Pub. Date: Nov. 23, 2023

(65) Prior Publication Data

US 2025/0313364 A1 Oct. 9, 2025

(30) Foreign Application Priority Data

May 19, 2022 (DE) ..... 102022112561.0

(51) Int. Cl.
*B65B 5/06* (2006.01)
*B65B 25/14* (2006.01)
(Continued)

(52) U.S. Cl.
CPC ..... *B65B 25/145* (2013.01); *B65B 5/067* (2013.01); *B65B 51/146* (2013.01); *B65B 61/06* (2013.01); *B65B 61/28* (2013.01)

(58) Field of Classification Search
CPC ..... B65B 5/067; B65B 25/145; B65B 61/28; B65B 7/02; B65B 43/42; B65B 43/52; B65G 47/88
(Continued)

(56) References Cited

U.S. PATENT DOCUMENTS 3,836,309 A * 9/1974 Thiel ..... B29C 51/18 425/383
4,183,194 A 1/1980 Lucke
(Continued)

FOREIGN PATENT DOCUMENTS

DE 4105452 A1 8/1992
DE 19749825 A1 5/1999
(Continued)

OTHER PUBLICATIONS

WIPO, International Search Report (in a corresponding application), Oct. 2, 2023.
(Continued)

*Primary Examiner* — Shelley M Self
*Assistant Examiner* — Patrick B Fry
(74) *Attorney, Agent, or Firm* — Laurence P. Colton; Smith Tempel Blaha LLC

(57) ABSTRACT

An apparatus and a method for handling bags for products, the bags having an opening via which they are each filled with product, forming the bag contents, and wherein walls of the bag are spaced apart from one another to introduce the bag contents into the respective bag via the opening, and wherein, after the bag contents have been fed into a bag, the respective opening is closed. The filled bag is conveyed in a conveying direction along a conveying path into a closing station, in which the filled bag is closed, wherein the filled bag is stopped in a predetermined position along the conveying path by a stop device to close the filled bag in the closing station, and the filled and closed bag is subsequently transferred to a conveying means in the conveying direction by a conveying device.

23 Claims, 5 Drawing Sheets

(51) Int. Cl.

| | |
|---|---|
| ***B65B 51/14*** | (2006.01) |
| ***B65B 61/06*** | (2006.01) |
| ***B65B 61/28*** | (2006.01) |
| ***B65G 47/88*** | (2006.01) |

(58) Field of Classification Search
USPC ..... 53/479, 284.7, 375.6; 198/577
See application file for complete search history.

(56) References Cited

U.S. PATENT DOCUMENTS

| | | | | |
|---|---|---|---|---|
| 4,241,562 | A * | 12/1980 | Meyer | B65B 43/34 53/529 |
| 5,860,270 | A | 1/1999 | Gerwe | |
| 9,188,208 | B2 * | 11/2015 | Ehrmann | B66F 3/12 |
| 11,518,554 | B2 * | 12/2022 | Kawashima | B65B 7/02 |
| 12,122,620 | B1 * | 10/2024 | Kalm | B65G 67/20 |
| 2002/0108355 | A1 | 8/2002 | Vignoli | |

FOREIGN PATENT DOCUMENTS

| | | | | |
|---|---|---|---|---|
| DE | 69614456 | T2 | 4/2002 | |
| DE | 102006028796 | A1 | 12/2007 | |
| DE | 102011105967 | A1 | 1/2013 | |
| DE | 202016102943 | U1 | 9/2017 | |
| WO | WO-2021131328 | A1 * | 7/2021 | B65B 7/02 |

OTHER PUBLICATIONS

Deutsches Patent- Und Markenamt (German Patent and Trademark Office), Recherchebericht (search in a corresponding application), Mar. 24, 2023.

* cited by examiner

METHOD AND APPARATUS FOR THE HANDLING OF BAGS FOR (HYGIENE) PRODUCTS

CROSS REFERENCE TO RELATED APPLICATIONS

This application is the US national phase of and claims the benefit of and priority on International Application No. PCT/EP2023/062223 having an international filing date of 9 May 2023, which claims priority on and the benefit of German Patent Application No. 10 2022 112 561.0 having a filing date of 19 May 2022.

BACKGROUND OF THE INVENTION

Technical Field

The invention relates to a method for handling bags for (hygiene) products, wherein the bags have an opening via which they are each filled with at least one product, forming the bag contents, and wherein walls of the bags are spaced apart from one another in the region of the opening in order to introduce the bag contents into the respective bag via the opening, and wherein, after the bag contents have been fed into a bag, the respective opening is closed, preferably by sealing the walls of the bag in the region of the opening Furthermore, the invention relates to a corresponding apparatus for handling bags for (hygiene) products, wherein the bags have an opening via which they can each be filled with at least one product, forming the bag contents, and wherein walls of the bags are spaced apart from one another in the region of the opening in order to introduce the bag contents into the respective bag via the opening, and wherein the apparatus is designed such that, after the bag contents have been fed into a bag, the respective opening is closed, preferably by sealing the walls of the bag in the region of the opening.

Prior Art

Numerous variants of methods and apparatus of the type mentioned at the outset are known from practice. A problem with the prior art may consist in closing the bags correctly. In particular, it can be observed that the bags are often closed or sealed unevenly.

Taking this as a starting point, the invention is based on the object of further developing methods and apparatus, in particular in terms of the correct closure of the bags, or at least providing alternative solutions.

BRIEF SUMMARY OF THE INVENTION

A method for achieving the above-mentioned object is a method for handling bags for (hygiene) products, wherein the bags have an opening via which they are each filled with at least one product, forming the bag contents, and wherein walls of the bags are spaced apart from one another in the region of the opening in order to introduce the bag contents into the respective bag via the opening, and wherein, after the bag contents have been fed into a bag, the respective opening is closed, preferably by sealing the walls of the bag in the region of the opening. It is therefore provided that, after the bag contents have been fed into a bag, the filled bag is conveyed in a conveying direction along a (linear) conveying path into a closing station, in which the filled bag is closed, wherein, in the closing station, the filled bag is stopped in a predetermined position along the conveying path by a stop device in order to close the filled bag in the closing station, and that the filled and closed bag is subsequently transferred to a conveying means, in particular a removal belt, in the conveying direction by a conveying device.

On the one hand, the solution according to the invention has the advantage that the bags are each stopped in the same position by the stop device, so that the closure of the bags always takes place consistently at a predetermined point. On the other hand, the bags, which are stationary during the closing process, may then be accelerated again such that their transportation on the conveying means is possible without any problems arising. This applies, in particular, when the conveying means is driven at high speed or with a high speed difference between the stationary filled bag and the conveying means.

It may preferably be provided that the stop device has a stop member, in particular a stop plate, which is positioned in the conveying path in order to serve as a stop for a filled bag in the predetermined position, wherein, after the closure of the respective bag, the stop member is moved out of the conveying path in order to clear the conveying path for the transfer of the filled and closed bag to the conveying means.

It may preferably be provided that the filled bags are conveyed into the closing station one after another and are each stopped individually by the stop device and then closed, whereupon the stop member is moved out of the conveying path and the respective filled and closed bag is transferred to the conveying means by the conveying device.

A further feature may consist in that, before reaching the predetermined position in the closing station, the filled bags are each decelerated by the stop member, in particular the stop plate, wherein, during their transportation in the conveying direction, the filled bags are each pressed against the stop member, which applies a predetermined pressure to the filled bag contrary to the conveying direction until the predetermined position is reached.

Furthermore, it may be provided that, during the deceleration of the filled bag, the stop member is displaced in the conveying direction by the filled bag until the filled bag has reached the predetermined position, wherein it is preferably provided that the stop member then no longer applies a predetermined pressure to the filled bag and, in particular, is spaced from the filled bag in the conveying direction.

Furthermore, it may be provided that the pressure exerted on the filled bag by the stop member for the purpose of decelerating the filled bag is kept constant during the deceleration, in particular by means of a pressure control valve.

In a preferred embodiment, it may be provided that the stop member is moved transversely, in particular perpendicularly, to the conveying path or conveying direction in order to stop the filled bag or clear the conveying path, and that the stop member is moved along the conveying path or in the conveying direction in order to decelerate the filled bag.

It is preferably provided that the bag contents are conveyed into the bag via the opening by means of a slide feed, and that the filled bag is conveyed into the closing station as a result of the slide feed abutting against the bag contents, and that the slide feed is then moved out of the bag via the opening in order to close the filled bag in the closing station.

It may furthermore be provided that excess bag material outside the seal region is separated in the closing station and removed from the closing station, in particular via a suction channel.

The method may preferably be used when the bag contents are a group of products, in particular a group of hygiene products, wherein the products or hygiene products are arranged next to one another, standing on a longitudinal edge with their longitudinal extent facing parallel to the conveying direction, to form a group.

An apparatus according to the invention is an apparatus for handling bags for (hygiene) products, wherein the bags have an opening via which they can each be filled with at least one product, forming the bag contents, and wherein walls of the bags are spaced apart from one another in the region of the opening in order to introduce the bag contents into the respective bag via the opening, and wherein the apparatus is designed such that, after the bag contents have been fed into a bag, the respective opening is closed, preferably by sealing the walls of the bag in the region of the opening. It is therefore provided that the apparatus is designed such that, after the bag contents have been fed into a bag, the filled bag is conveyed in a first conveying direction along a conveying path into a closing station, in which the filled bag is closed, and that the apparatus is designed such that, in the closing station, the filled bag is stopped in a predetermined position along the conveying path by a stop device in order to close the filled bag in the closing station, and that the apparatus is designed such that the filled and closed bag is subsequently transferred to a conveying means, in particular a removal belt, in the conveying direction by a conveying device.

It may preferably be provided that the stop device has a stop member, in particular a stop plate, which can be positioned in the conveying path in order to serve as a stop for a filled bag in the predetermined position, wherein the apparatus is designed such that, after the closure of the respective bag, the stop member is moved out of the conveying path in order to clear the conveying path for the transfer of the filled and closed bag to the conveying means.

Furthermore, it may be provided that, through rotation of a lever arm of the stop device, the stop member can be moved up and down in the vertical direction, namely transversely to the conveying path or the conveying direction.

One of many other conceivable alternatives may consist in that the stop member may be moved along a guide extending in the vertical direction via a (belt) drive, for example by coupling it to a sliding carriage which is displaceable along the guide.

It is preferably provided that the stop member can be moved contrary to the conveying direction for the purpose of decelerating the filled bag, wherein a predetermined pressure p1 may be applied to the stop member via a pneumatic cylinder in order to decelerate the filled bags transported in the conveying direction.

It is preferably provided here that the apparatus is designed to keep the predetermined pressure p1 constant via a pressure control valve.

In a preferred embodiment, it may be provided that sealing bars are arranged in the closing station for the purpose of closing the bag in the region of the opening and that a push device of the conveying device catches hold of the filled and closed bag between the sealing bars and the bag contents and accelerates it in the conveying direction.

It may preferably be provided that the filled bag rests on a path plate in the closing station, and that the push device is designed as a fork-like member with multiple, in particular three, prongs, which pass through corresponding cutouts in the path plate in order to be brought into contact with the filled bag.

It may preferably be provided that the movement of the conveying device is realized via a linkage with two servo drives.

Numerous alternatives are also conceivable here. For example, the push device might be moved in the horizontal direction via a linear unit, whereas the vertical movement of the push device may take place via a carriage which is displaceable in relation to the linear unit.

It is preferably provided that the conveying means, in particular the removal belt, is driven continuously (and at high speed).

In a preferred configuration of the apparatus, it may be provided that a cutting device for separating excess bag material is arranged in front of the closing station or the sealing bars which belong to the closing station for the purpose of sealing the bag in the region of the opening.

The separated excess bag material may be disposed of via a suction channel associated with the closing station.

A further feature may consist in that the conveying device with the push device is arranged at a predetermined spacing from the closing station, in particular in that the conveying device with the push device is mechanically connected to the closing station and can only be moved together with this, maintaining the predetermined spacing.

The stop member and/or the push device may be adapted to a variety of bag forms (differing bag width, length and height), for example by changing the members for members with dimensions corresponding to the bags to be handled.

A further feature may consist in that the conveying device with the push device is arranged at a predetermined spacing from the closing station, in particular in that the conveying device with the push device is mechanically connected to the closing station and can only be moved together with this, maintaining the predetermined spacing.

BRIEF DESCRIPTION OF THE DRAWINGS

A preferred exemplary embodiment of the invention is explained below with reference to the drawing, in which.

DETAILED DESCRIPTION OF PREFERRED EMBODIMENTS

Figure 1:
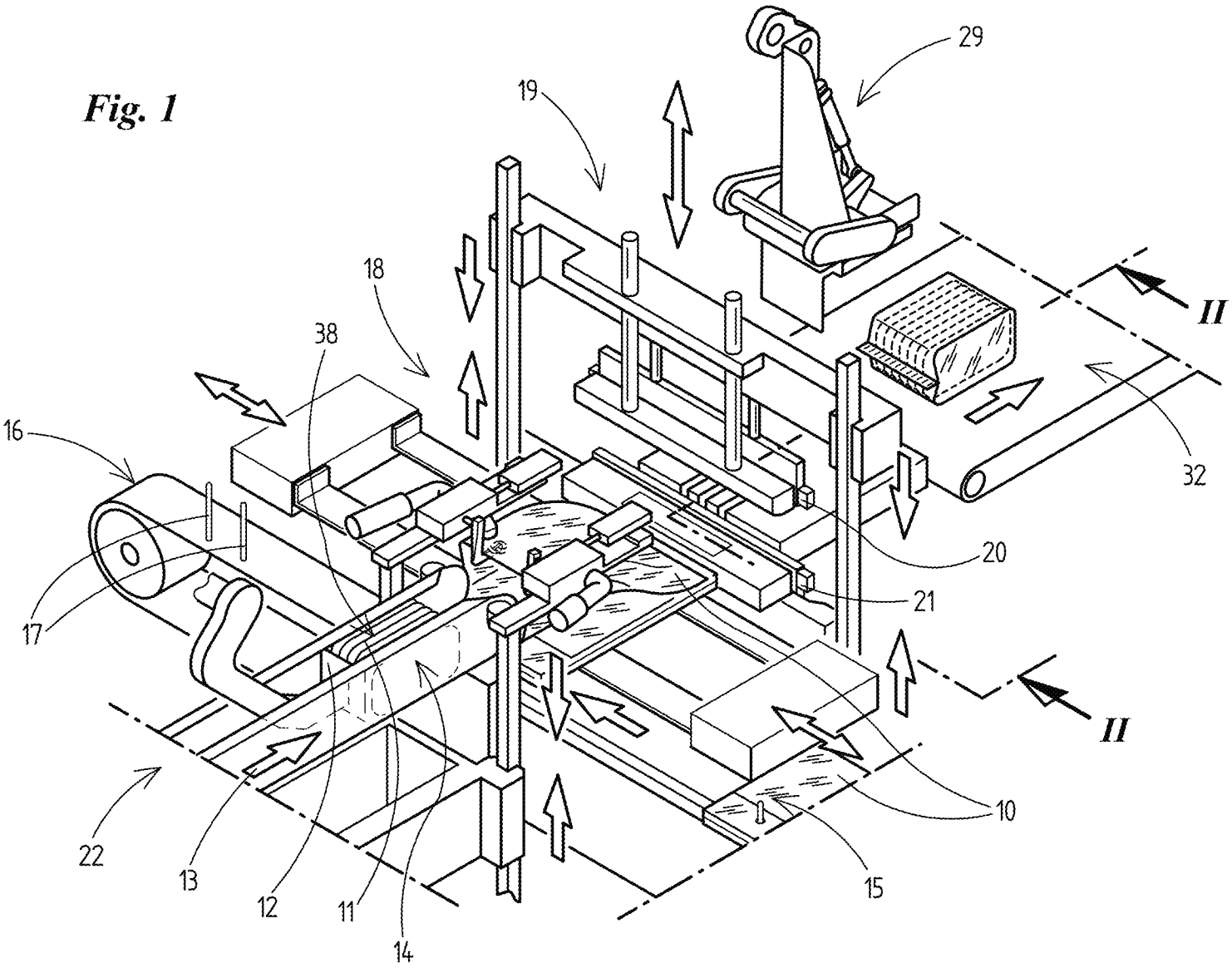
FIG. 1 shows an apparatus for handling bags in a schematic three-dimensional illustration.

The invention is described below with reference to an apparatus for handling bags 10 in connection with the packaging of hygiene products, namely nappies. However, since the apparatus is also suitable for other items, the description below focuses on products 11 in general.

The products 11 are preferably packaged in a bag 10 as a group 38 of products 11 forming the bag contents. The number of products 11 in the bag 10 may vary. It is also conceivable for there to be only one product 11 in the bag 10. In practice, there will be multiple products 11 within a preferably cuboidal group 38.

If the products 11 are the aforementioned nappies, the nappies are placed together, standing on a longitudinal side in a regular arrangement, to form a cuboidal group 38, wherein the longitudinal extent of the nappies faces in the conveying direction. The group 38 of nappies is preferably also compressed before being packaged in the bag, in order to reduce the dimensions of the group 38.

The feed operation of the products 11 takes place by means of a slide feed 12, which introduces the products 11 into a bag 10 which is held ready and stretched open. The slide feed 12 abuts with its rear side against the products 11 or the group 38 thereof and transports them in the conveying direction 13 into the bag 10. In the present case, in which the products 11 are nappies, the slide feed 12 cooperates with a so-called shuttle 14. The slide feed 12 and shuttle 14 are already known from the prior art, so a detailed description is not necessary.

By means of a belt conveyor 16 with pin holders 17, the bags 10 are transferred as a stack of bags 15 into a bag opening station 18, where the bags are filled 10 with the products 11 individually, one after another, via an opening 25 of the bag 10. The construction and mode of operation of the bag opening station 18 are likewise known from the prior art.

Figure 2:
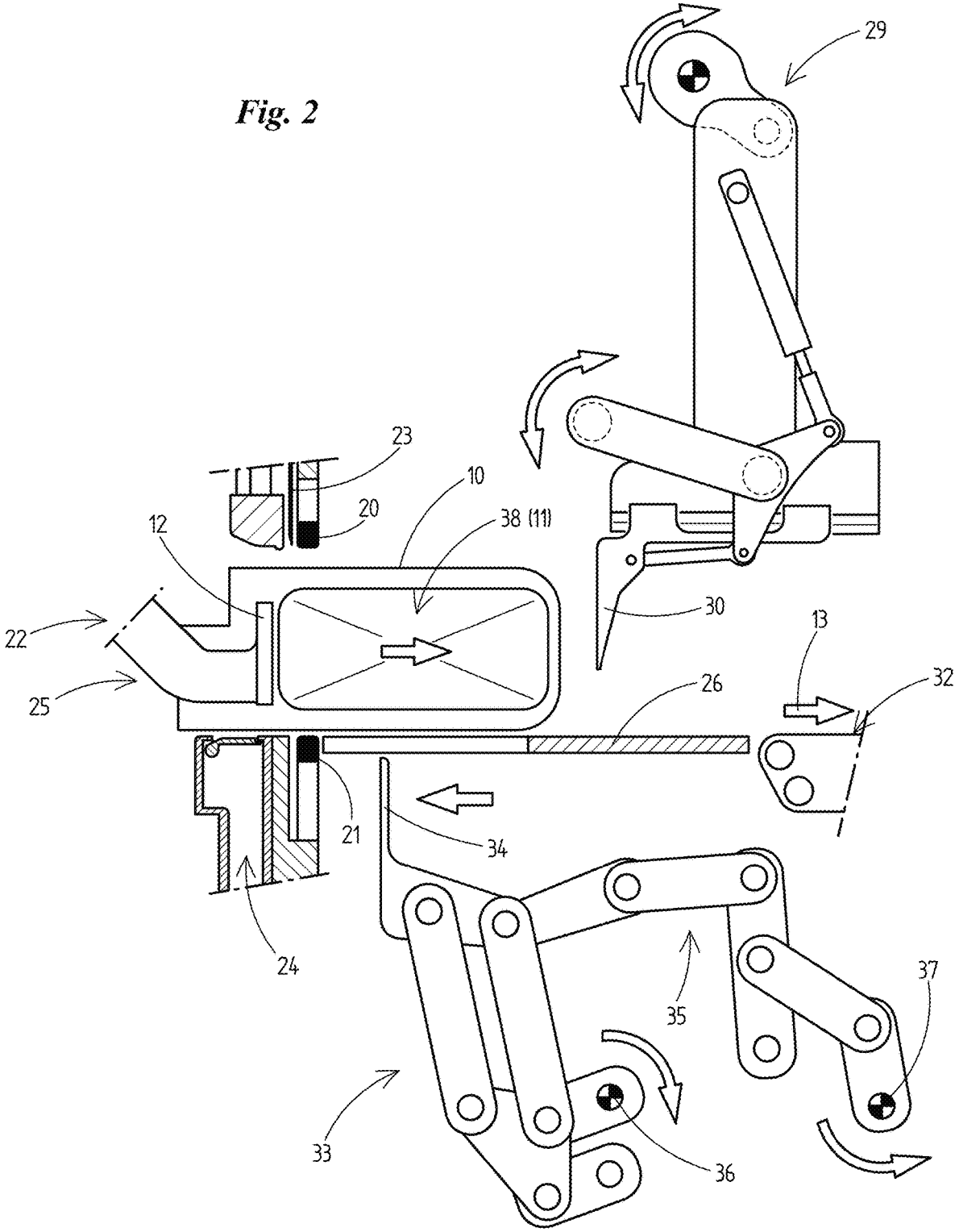
FIGS. 2 to 5 show a vertical section through the apparatus along section line II-II in FIG. 1 during successive phases of the movement sequence.

Following the bag opening station 18, the filled bags 10 are conveyed in a closing station 19 via the slide feed 12 (FIG. 2). The slide feed 12 here extends through the opening 25 of the bag 10 and abuts with its rear side against the back of the group 38 of products 11, i.e. as seen in the conveying direction 13.

Figure 3:
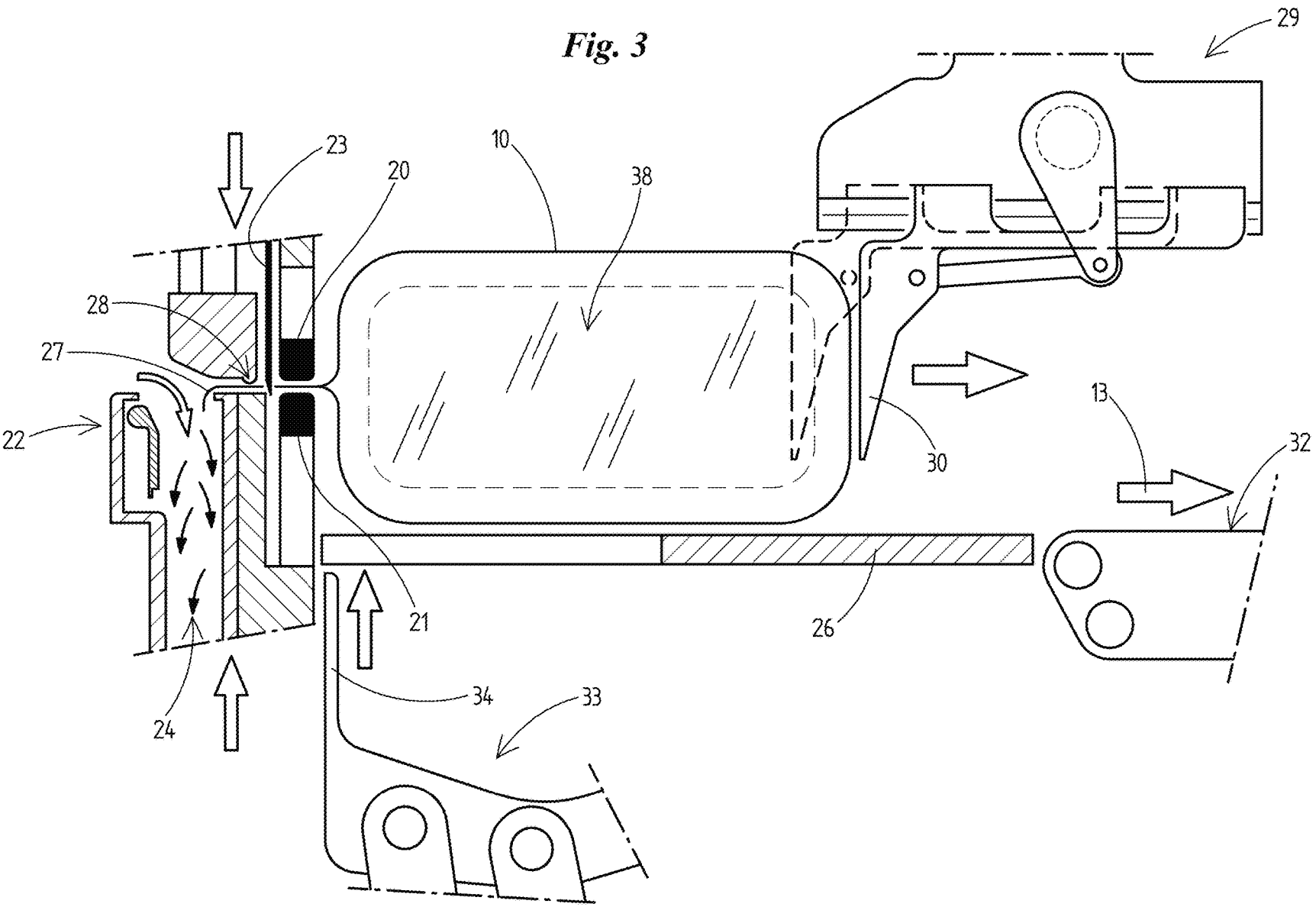

In the next step, the filled bags 10 are closed in the closing station 19. In the present case, this takes place by means of two sealing bars 20, 21, which are arranged above and below the conveying path 22 of the filled bags 10 and can be moved together in order to close the bag 10 by sealing (FIG. 3). The bag 10 here rests on a path plate 26. Excess material 27 may be separated by a cutting device 23 and disposed of via a suction channel 24 (FIG. 3). The bag material 27 to be separated is firstly held in a holding unit 28 in order to make the separating cut. After the separating cut has been made, the holding unit 28 is released and the bag material 27 is removed via the suction channel 24.

Finally, the filled and closed bag 10 is removed via a conveying means 32, in particular a removal belt, adjoining the path plate 26. The removal belt or conveying means 32 is preferably driven continuously and at high speed.

In order to be able to close the bags in a consistent, predetermined position in each case, a stop device 29 is used. The stop device 29 is arranged at a spacing downstream of the closing station 19 and has a stop member 30, for example in the form of a stop plate, with which the bags 10 are stopped in a predetermined position along the conveying path 22. To this end, the stop member 30 of the stop device 29 is positioned in the conveying path 22 of the filled bags 10 so that the filled bags 10 push against the stop member 30 and are stopped. In this way, all bags 10 may be stopped, one after another, in the same position at a spacing from the closing station 19 so that the closure of the bags 10 may take place in a consistent manner.

Figure 5:
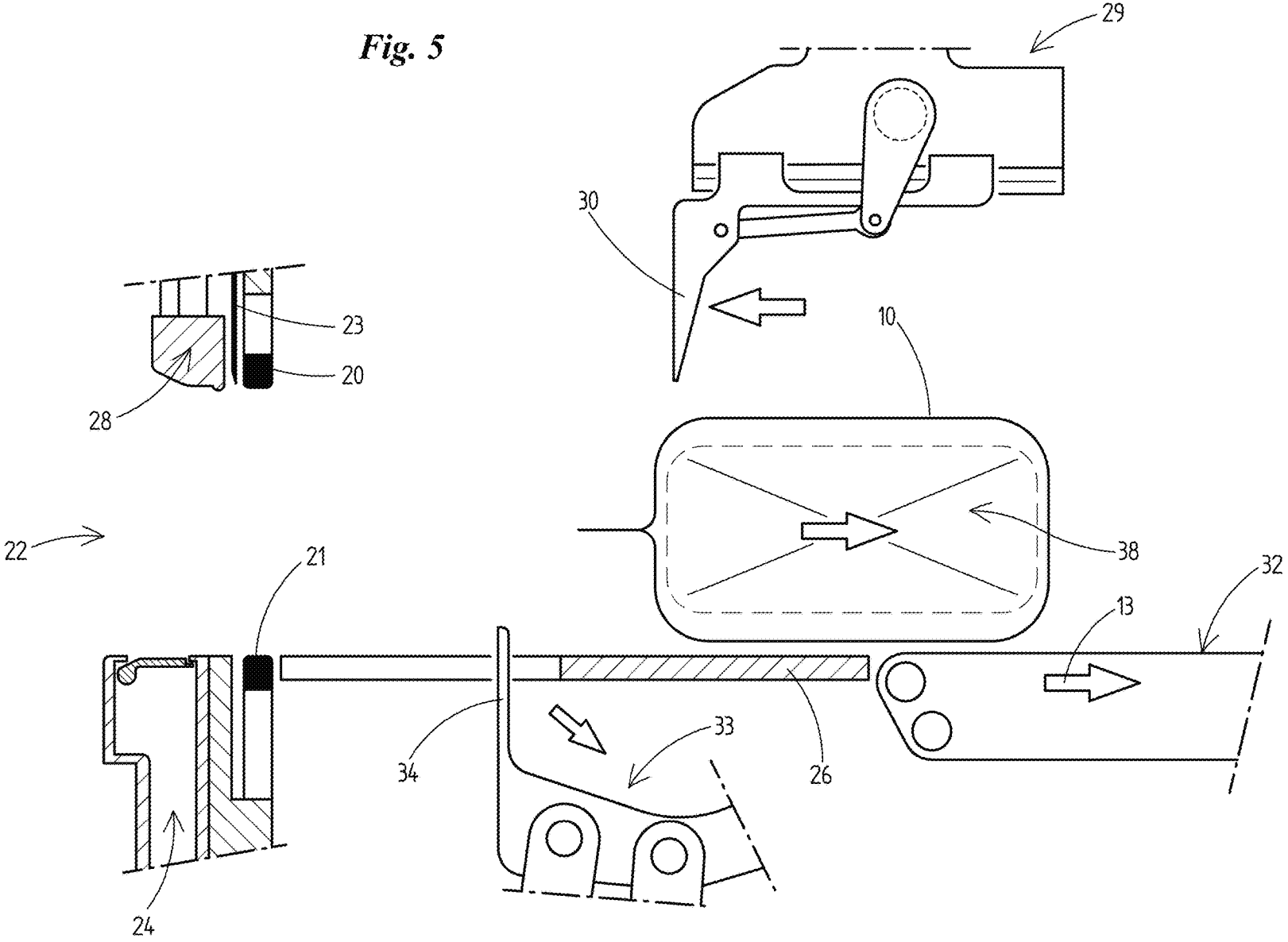

In a starting position according to FIG. 5, the stop device 29 with the stop member 30 is arranged above the conveying path 22, wherein the stop plate is moved contrary to the conveying direction 13 into a front position. In this position, the filled and closed bags 10 may be conveyed onto the removal belt without colliding with the stop device 29.

In the next step, the stop member 30 is lowered into the conveying path 22 so that the next bag 10 to be closed may be stopped (FIG. 2). A further feature here is shown in FIG. 3. The stop member 30 is namely pushed in the conveying direction from the front position by the filled bag 10 until the predetermined position of the filled bag 10 is reached. In this way, the filled bag 10 is firstly decelerated and not stopped abruptly, in order to protect the bag contents. By way of example, the stop member 30 may be pushed 40 mm in the conveying direction 13. It is provided that, during this deceleration, the stop member 30 exerts a predetermined constant pressure p1 on the filled bag 1, which is controlled, for example, by a pressure control valve. After the filled bag has reached the predetermined position, the pressure p1 is no longer applied and the stop member 30 may even be slightly removed from the filled bag 12 in the conveying direction 13.

Figure 4:
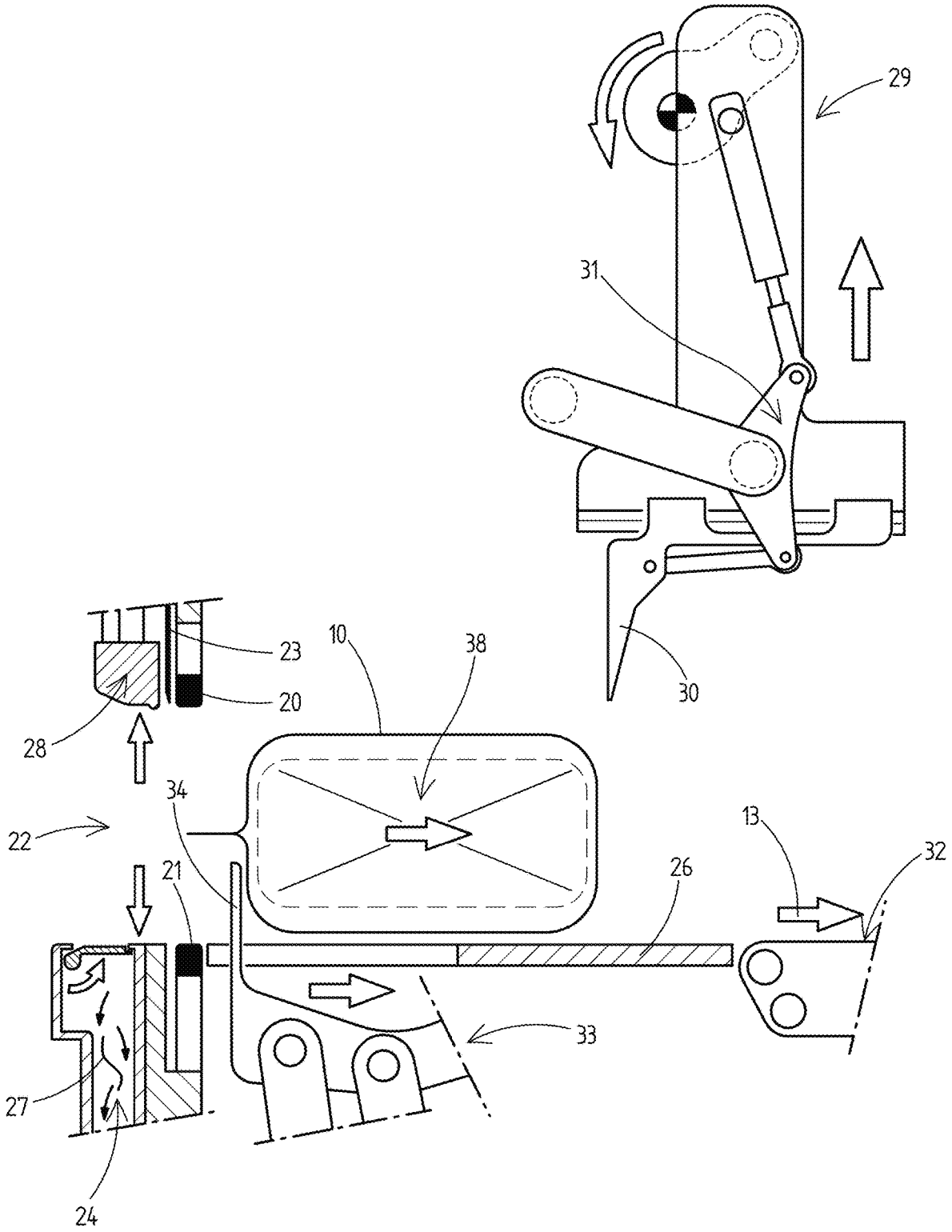

In order to clear the way for the removal of the filled and closed bags 10, the stop device 29 is then moved upwards in the vertical direction, according to FIG. 4. In the upper end position, pressure is then applied to the stop plate 30 again and this latter is moved out into the front position, whereupon the cycle begins again.

In structural terms, the movement of the stop member 30 in the vertical direction may be realized via a rotation of a lever arm 30. Alternatively, the stop member 30 may be moved in the vertical direction via a sliding carriage with a belt drive. The horizontal movement of the stop member 30 preferably takes place by means of a pressure cylinder in combination with a linear rail.

In order to transfer the filled and closed bags 10 to the conveying means 32 following the path plate 27, a conveying device 33 is provided with a push device 34. This ensures the acceleration of the group 38 of products 11, which are at a standstill after the sealing process. The conveying means 32 may thus be operated at a continuous and high speed. Without the use of the push device 34, the conveying means 32 would initially have to start off slowly owing to the slip which occurs between the stationary group 38 and the belt surface, which reduces the possible number of cycles. If the number of cycles is 70 cycles per minute, the push device 34 may accelerate the filled and closed bags 10 to ca. 43 $m/s^2$.

The push device 34 may be in the form of a fork-like member with multiple fingers/prongs, which catch hold of the filled and closed bags 10 on the rear side and accelerate them in the direction of the continuously driven conveying means 32. In this way, the filled and closed bags 10 may be brought to an appropriate speed and transported out of the closing station 19, without having to reduce the feed speed or the removal speed.

A linkage with two servo motors 36, 37, which are arranged below the path plate 26, serves as the drive for the push device 34. The fingers or prongs of the push device 34 project through slot-like cutouts in the path plate 26 from below and catch hold of the filled and closed bags 10 between the sealing bars 20, 21 and bag 10 and transport the filled and closed bags 10 in the horizontal conveying direction 13 to the conveying means 32. The push device 34 is then moved downwards and back into a starting position below the path plate 26 and moved upwards again in the vertical direction for the transportation of the next filled and closed bag 10.

The position of the push device 34 or the conveying device 33 relative to the closing station 19 or the sealing bars 20, 21 is constant: for example, the conveying device 33 and closing station 19 may be screwed together so that they may only be moved together.

LIST OF REFERENCE SIGNS

10 Bag
11 Product
12 Slide feed
13 Conveying device
14 Shuttle

15 Stack of bags
16 Belt conveyor
17 Pin holder
18 Bag opening station
19 Closing station
20 Sealing bar
21 Sealing bar
22 Conveying path
23 Cutting device
24 Suction channel
25 Opening (bag)
26 Path plate
27 Bag material
29 Holding unit
29 Stop device
30 Stop member
31 Lever arm
32 Conveying means (removal belt)
33 Conveying device
34 Push device
35 Linkage
36 Servo motor
37 Servo motor
38 Group

The invention claimed is:

1. A method for handling bags (10) for products (11), wherein the bags (10) each have an opening (25) via which the bags (10) are each filled with at least one product (11), forming the bag contents, and wherein walls of the bags (10) are spaced apart from one another in the region of the opening (25) in order to introduce the bag contents into the respective bag (10) via the opening (25), and wherein, after the bag contents have been fed into the bag (10), the respective opening (25) is closed, the method comprising:

conveying the filled bag (10) in a conveying direction (13) along a conveying path (22) into a closing station (19), in which the filled bag (10) is closed;

in the closing station (19), stopping the filled bag (10) in a predetermined position along the conveying path (22) by a stop device (29), wherein stopping the filled bag (10) comprises moving a stop member (30) of the stop device (29) transversely to the conveying path (22) into the conveying path (22), and decelerating the filled bag (10) by pressing the stop member (30) against the filled bag (10) with a predetermined pressure (p1) contrary to the conveying direction (13), wherein the stop member (30) is displaced in the conveying direction (13) by the filled bag (10) until the predetermined position is reached;

closing the filled bag (10) in the closing station (19);

moving the stop member (30) transversely out of the conveying path (22) to clear the conveying path; and subsequently transferring the filled and closed bag (10) to a conveying means (32) in the conveying direction (13) by a conveying device (33).

2. The method as claimed in claim 1, wherein the stop member (30) is positioned in the conveying path (22) to stop the filled bag (10) in the predetermined position, wherein, after the closure of the respective bag (10), moving the stop member (30) out of the conveying path (22) in order to clear the conveying path (22) for the transfer of the filled and closed bag (10) to the conveying means (32).

3. The method as claimed in claim 2, wherein the filled bags (10) are conveyed into the closing station (19) one after another and are each stopped individually by the stop device (29) and then closed, whereupon the stop member (30) is moved out of the conveying path (22) and the respective filled and closed bag (10) is transferred to the conveying means (32) in the conveying direction (13) by the conveying device (33).

4. The method as claimed in claim 2, wherein the stop member (30) is a stop plate.

5. The method as claimed in claim 1, wherein the pressure exerted on the filled bag (10) by the stop member (30) for the purpose of decelerating the filled bag (10) is kept constant during the deceleration.

6. The method as claimed in claim 5, wherein the pressure exerted on the filled bag (10) by the stop member (30) for the purpose of decelerating the filled bag (10) is kept constant during the deceleration by means of a pressure control valve.

7. The method as claimed in claim 1, wherein the bag contents (10) are conveyed into the bag (10) via the opening (25) by means of a slide feed (12), wherein the filled bag (10) is conveyed into the closing station (19) as a result of the slide feed (12) abutting against the bag contents, and wherein the slide feed (12) is then moved out of the bag (10) via the opening (25) in order to close the filled bag (10) in the closing station (19).

8. The method as claimed in claim 1, wherein excess bag material outside the seal region is separated in the closing station (19) and removed from the closing station (19).

9. The method as claimed in claim 1, wherein the bag contents are a group (38) of products (11), wherein the products (11) in the group (38) of products are arranged next to one another, standing on a longitudinal edge with their longitudinal extent facing parallel to the conveying direction (13), to form a group (38).

10. An apparatus for handling bags for products (11), wherein the bags (10) have an opening (25) via which the bags (10) are each filled with at least one product (11), forming the bag contents, and wherein walls of the bags (10) are spaced apart from one another in the region of the opening (25) in order to introduce the bag contents into the respective bag (10) via the opening (25), and wherein the apparatus is structured such that, after the bag contents have been fed into the bag (10), the respective opening (25) is closed, the apparatus comprising a stop device (29) having a stop member (30), wherein the apparatus is structured such that, after the bag contents have been fed into a bag (10), the filled bag (10) is conveyed in a conveying direction (13) along a conveying path (22) into a closing station (19), in which the filled bag (10) is closed, wherein the apparatus is structured such that, in the closing station (19), the filled bag (10) is stopped in a predetermined position along the conveying path (22) by the stop device (29) in order to close the filled bag (10) in the closing station (19), wherein the apparatus is structured such that the filled and closed bag (10) is subsequently transferred to a conveying means (32) in the conveying direction (13) by a conveying device (33), wherein the stop device (29) is configured to move the stop member (30) transversely to the conveying path (22) into and out of the conveying path (22), and to move the stop member (30) along the conveying path (22) to decelerate the filled bag (10) by applying a predetermined pressure (p1) to the filled bag (10) contrary to the conveying direction (13).

11. The apparatus as claimed in claim 10, wherein the stop member (30) is positioned in the conveying path (22) to stop the filled bag (10) in the predetermined position, wherein the apparatus is structured such that, after the closure of the respective bag (10), the stop member (30) is moved out of the conveying path (22) in order to clear the conveying path (22) for the transfer of the filled and closed bag (10) to the conveying means (32).

12. The apparatus as claimed in claim 11, wherein, through rotation of a lever arm of the stop device (29), the stop member (30) is movable up and down in the vertical direction, namely transversely to the conveying path (22) or the conveying direction (13).

13. The apparatus as claimed in claim 11, wherein the apparatus is structured to keep the predetermined pressure (p1) constant via a pressure control valve.

14. The apparatus as claimed in claim 11, wherein the stop member (30) is a stop plate.

15. The apparatus as claimed in claim 10, further comprising sealing bars (20, 21) arranged in the closing station (19) for the purpose of closing the bag (10) in the region of the opening (25), and further comprising a push device (34) of the conveying device (33) for catching and holding the filled and closed bag (10) between the sealing bars (20, 21) and the bag contents and for accelerating the filled and closed bag (10) in the conveying direction (13).

16. The apparatus as claimed in claim 15, wherein the filled bag (10) rests on a path plate (26) in the closing station (19), and in that the push device (34) is structured as a fork-like member with multiple prongs, which pass through corresponding cutouts in the path plate (26) in order to be brought into contact with the filled bag (10).

17. The apparatus as claimed in claim 15, further comprising a cutting device (23) for separating excess bag material, wherein the cutting device (23) is arranged in front of the closing station (19) or the sealing bars (20, 21) which belong to the closing station (19) for the purpose of sealing the bag (10) in the region of the opening (25).

18. The apparatus as claimed in claim 17, wherein the separated excess bag material is disposed of via a suction channel (24) associated with the closing station (19).

19. The apparatus as claimed in claim 17, wherein the conveying device (33) with the push device (34) is arranged at a predetermined spacing from the closing station (19).

20. The apparatus as claimed in claim 19, wherein the conveying device (33) with the push device (34) is mechanically connected to the closing station (19) and moved together with the closing station (19), maintaining the predetermined spacing.

21. The apparatus as claimed in claim 15, wherein the push device (34) is structured as a fork-like member with three prongs.

22. The apparatus as claimed in claim 10, wherein movement of the conveying device (33) is realized via a linkage (35) with two servo drives (36, 37).

23. The apparatus as claimed in claim 10, wherein the conveying means (32) is driven continuously.

* * * * *